United States Patent [19]

Suter

[11] 4,337,862

[45] Jul. 6, 1982

[54] FLEXIBLE VERTICAL FORM, FILL, SEAL PACKAGING MATERIAL AND METHOD OF USING

[75] Inventor: Andrew K. Suter, Brampton, England

[73] Assignee: The Wiggins Teape Group Limited, Basingstoke, England

[21] Appl. No.: 586

[22] Filed: Jan. 2, 1979

[30] Foreign Application Priority Data

Jan. 9, 1978 [GB] United Kingdom ..... 722/78

[51] Int. Cl.[3] ..... B65D 3/26; B65B 9/00; B32B 27/00

[52] U.S. Cl. ..... 206/632; 53/451; 426/127; 426/415; 428/35; 428/347; 428/349; 428/352; 428/537

[58] Field of Search ..... 426/127, 415; 428/40, 428/537, 35, 347, 349, 352; 53/451

[56] References Cited

U.S. PATENT DOCUMENTS

| | | | |
|---|---|---|---|
| 2,154,521 | 4/1939 | Maxfield | 93/3 |
| 3,217,871 | 11/1965 | Lee | 206/63.2 |
| 3,259,507 | 7/1966 | Smith | 426/127 |
| 3,391,089 | 7/1968 | Goodwin et al. | 206/439 |
| 3,426,499 | 2/1969 | Paige | 53/451 |
| 3,511,746 | 5/1970 | Davies | 156/291 X |
| 3,599,387 | 8/1971 | James | 53/451 |
| 3,608,707 | 9/1971 | Miller | 206/46 F |
| 3,655,503 | 4/1972 | Stanley et al. | 161/165 |
| 3,724,163 | 4/1973 | Roussel | 53/171 |
| 3,903,335 | 9/1975 | Jones | 427/361 |
| 3,935,048 | 1/1976 | Rucker | 53/451 |
| 4,151,319 | 4/1979 | Sackoff et al. | 428/352 |

FOREIGN PATENT DOCUMENTS

| | | |
|---|---|---|
| 876503 | 4/1953 | Fed. Rep. of Germany . |
| 1026671 | 3/1958 | Fed. Rep. of Germany . |
| 1486586 | 7/1969 | Fed. Rep. of Germany . |
| 1761473 | 7/1971 | Fed. Rep. of Germany . |
| 2131322 | 1/1973 | Fed. Rep. of Germany . |
| 2408287 | 8/1975 | Fed. Rep. of Germany . |
| 787288 | 12/1957 | United Kingdom . |
| 954599 | 4/1964 | United Kingdom . |
| 1058074 | 1/1967 | United Kingdom . |
| 1093671 | 12/1967 | United Kingdom . |
| 1122537 | 8/1968 | United Kingdom . |
| 1294352 | 10/1972 | United Kingdom . |
| 1353471 | 5/1974 | United Kingdom . |
| 1380621 | 1/1975 | United Kingdom . |
| 1405006 | 9/1975 | United Kingdom . |
| 1440449 | 6/1976 | United Kingdom . |
| 1510384 | 5/1978 | United Kingdom . |

OTHER PUBLICATIONS

"Flexible Pouches–Form, Fill, Seal" in Modern Packaging Ency., 1971, pp. 174–180 by Nethers et al.

*Primary Examiner*—William R. Dixon, Jr.
*Attorney, Agent, or Firm*—Shlesinger, Arkwright, Garvey & Dinsmore

[57] ABSTRACT

Flexible packaging material suitable for making peelable form-fill-seal packages of the "pillow" type comprises a paper web which is coated with a normally non-tacky pressure- or heat-activatable adhesive and which is treated with a composition having release properties with respect to the adhesive, e.g. by means of a size press. The release composition is preferably a polysiloxane, an organo-chromium stearate complex, a ketene dimer or a paper fluoridizing agent.

21 Claims, 3 Drawing Figures

FLEXIBLE VERTICAL FORM, FILL, SEAL PACKAGING MATERIAL AND METHOD OF USING

This invention relates to flexible packaging material, a packaging method using the material and packages made thereby. Whilst the packaging material is suitable for making packages by various methods, it is particularly adapted for use in vertical form-fill-seal packaging to produce packages of the "pillow" type.

In vertical form-fill packaging to produce packages of the "pillow" type, a continuous web of material is formed into a generally tubular configuration and the two longitudinal edges of the web are bonded together. Opposed transverse portions of the tube so formed are then bonded together at a first location to provide a first package and closure. A desired quantity of fill is then dispensed into the partly-closed tube, further opposed transverse portions of which are then bonded together at a second location beyond the fill to form a second package and closure, and thus a completely closed package. A single sealing operation serves simultaneously to provide both the second package end closure of one package and the first package end closure of the next package. Thus discrete packages can be produced simply by cutting the tube at each bonded portion between the packages. Such packages are generally referred to as being of the "pillow" type.

Numerous materials may be used in form-fill packaging, for example plastics or regenerated cellulose films, paper webs, and foil/paper laminates.

Bonding of the web to form the tube and the package end closures is normally brought about simply by clamping for a short period of time between jaws or other pressure members. If a thermoplastic web is used, for example a polyolefin film, a polyolefin-coated paper or a paper web containing a high proportion of thermosplastic synthetic fibres, it is conventional for the pressure members to be heated, in which case an adhesive is not normally required as the web surfaces become fused together. However, if a non-thermoplastic web is used, for example a paper web made wholly of cellulosic fibres, it is necessary for the web to carry a coating of a heat-or pressure-activatable adhesive, the pressure members being heated or unheated depending on the type of adhesive used. The adhesive is normally substantially non-tacky until it is activated. A suitable type of heat-activated adhesive is a hot-melt adhesive. Such an adhesive can, if suitably formulated, be used also to impart barrier properties to the web. For example, the permeability of the web to water vapour or oil or grease can be reduced to a very low level by the use of a suitable hot-melt adhesive coating. Low permeability to water vapour is often required when foodstuffs are to be packaged.

Bonds made of fusion of thermoplastic materials or by the use of heat- or pressure-activatable adhesives are frequently difficult or impossible to peel apart. Thus it is necessary for the user to cut or tear the material in order to get at the contents of the package. This is a drawback of form-fill packaging, particularly if it is desired to use only part of the contents of the package at any one time (as may be the case, for example with breakfast cereal or savoury biscuit packages), since the cutting or tearing necessary to open the pack destroys or at least impairs the subsequent storage properties of the package. In contrast, a package which can be opened simply by peeling apart the bonded material suffers no substantial structural damage and is still useable if the package is re-closed by folding over the peeled-apart ends of the material. A peelable bond is thus a desirable feature of packages for many purposes.

It might be thought that peelability could be achieved simply by adjusting the duration of the bonding operation and the temperature and pressure applied to the web to make the bond, or by using an inherently weak adhesive, or by bonding at intermittent portions only of the surfaces to be sealed, so reducing the bond strength compared with that obtained by bonding over the whole area of the surfaces to be sealed. Such approaches have been proposed for various types of packaging, but in the case of vertical form-fill packaging, the objective of an easily peelable bond conflicts with the need for that same bond to be strong enough to withstand the filling operation. For example, the bond must be able to withstand the weight of the fill material dropping into a partly-bonded package. This problem is particularly serious in the case of bonds achieved by the use of heat-activated adhesives, because the full adhesive strength normally develops only on cooling of the adhesive and the webs. The filling operation however takes place immmediately after the bonding operation, while the bonded portion of the tube is still hot. If the bonded portion were allowed time to cool, the speed of the packaging line would be greatly reduced. It is therefore necessary to use a fairly powerful adhesive with good "hot tack" properties i.e. an adhesive which will form a strong bond immediately on activation and whilst still hot. Such an adhesive tends however to produce a non-peelable seal.

In considering the problem of making a flexible packaging material for use in vertical form fill seal packaging as previously described, it must be borne in mind that the problem with paper is usually more serious than with plastic films or regenerated cellulose films. This is because such films can normally withstand much stronger peel-apart forces than paper, which tends to split within its thickness (by rupture of fibre to fibre bonds) or simply to tear. Thus a relatively stronger adhesive can be used for films than for paper whilst still achieving a peelable seal.

It has however been proposed to produce peelable seals in packages made wholly or partly of paper by the use of various bond weakening materials. For example, U.K. Pat. No. 1,294,352 proposes the use of separate sheets of different materials, one of which (e.g. a polyolefin sheet) is coated with a weak adhesive and the other of which is paper treated with a lacquer which is incompatible with the adhesive. The bonded sheets can thus be peeled from one another. Another proposal utilizing the bonding of two separate sheets is disclosed in U.K. Pat. No. 1,365,769. At least one of the sheets is an adhesive coated paper sized under neutral conditions with an alkyl ketene dimer sizing agent. The sizing prevents absorption of adhesive by the base material both during application and subsequent heat sealing. Yet a further proposal utilizing the bonding of two separate sheets is disclosed in U.K. Pat. No. 1,510,384. A paper sheet is coated with a blush lacquer and then with adhesive, and then is stuck to a further sheet, e.g. of plastics, to form a package. The blush lacquer is formulated to be of low cohesive strength, so that the package is openable by peeling apart the sheets with bond breaking within the blush lacquer coating rather than within the adhesive coating or at the interface between the lacquer and the adhesive or the lacquer and the paper. It will be appreciated that a package derived from two separate sheets is not susceptible to manufacture by vertical form-fill seal packaging as previously described, since the latter utilizes a single packaging material which bonds to itself.

It has now been found that a paper web can be used in vertical form-fill-seal packaging to form peelable-seal packages of the "pillow" type if the web is treated with a composition which imparts release properties with respect to the adhesive with which the web is subsequently coated.

Accordingly, the present invention provides, in a first aspect, flexible packaging material suitable for use in vertical form fill seal packaging to produce packages of the pillow type comprising a paper web which is coated on one surface with an adhesive which is normally substantially non-tacky but which is activatable by heat and/or pressure and which is treated with a composition having release properties with respect to the adhesive, with the result that two thicknesses of the paper are bondable together by hot or cold pressing their adhesive-coated surfaces together, and that the bond so formed is peelable apart at an adhesive/release-treated paper interface.

In a second aspect, the present invention provides a package comprising bonded thicknesses of flexible packaging material as just defined, the bonded thicknesses being peelable apart at an adhesive/release-treated paper interface. Preferably the package comprises a single piece of flexible packaging material, longitudinal edge portions of the adhesive-coated surface of which are bonded together to provide a longitudinal package closure and oppositely disposed transverse edge portions of the adhesive-coated surface of which are bonded together to provide package end closures.

In a third aspect, the present invention provides a method of packaging a fill material comprising the steps of dispensing a quantity of fill material adjacent one thickness of flexible packaging material as defined above, and bonding another thickness of the same flexible sheet packaging material to the first thickness by hot or cold pressing the adhesive-coated surfaces of the thicknesses together, thereby to enclose the fill material and to form a closed package, the bonded thicknesses of which are peelable apart at an adhesive/release-treated paper interface. Preferably, the method comprises the steps of forming a continuous web of the paper into a tubular configuration, bonding longitudinal edge portions of the adhesive-coated surface of the web together to form a longitudinal package closure, bonding opposite disposed transverse portions of the adhesive-coated surface of the web together to form a first package end closure, dispensing a desired quantity of fill material into the part-package thus formed, and bonding further opposed transverse portions of the adhesive coated surface of the web together beyond the dispensed fill material to form a second package end closure.

Although the flexible packaging material according to the invention is particularly adapted for use in vertical form-fill-seal packaging to produce packages of the pillow type, it will be appreciated that it can be used in a number of other types of packaging methods, for example those described in "Modern Packaging Encyclopaedia, 1971 Issue" in a section entitled "Flexible Pouches—form, fill seal" by R. L. Nethers, H. A. Boyle, and R. G. Marklund.

It has so far been found preferable for the treatment of the paper web to be such that the composition having release properties is present within the thickness of the web as well as on its surface. This is preferably achieved by size press application of the composition having release properties. Alternatively, furnish addition, coating, impregnation or spraying techniques may for example be used.

Materials having release properties with respect to adhesives are widely known. Preferred examples of such materials which may be used in release compositions for use in the present packaging material are aqueous silicone compositions (polysiloxanes); so-called Werner chrome complexes (organo-chromium stearate complexes) e.g. those sold under the designations "Quilon" by Du Pont and "Ergapel C" by Ciba Geigy; ketene dimer resins, such as that sold as "Aquapel" by Hercules Powder Co.,; or so-called paper fluoridizing agents, e.g. the product sold as "Scotchban" 807 by 3M. Metal stearates, e.g. calcium potassium, zinc or aluminium stearate, may also be used. Mixtures of the foregoing may be used. A typical release material content, on a dry basis, is in the range $\frac{1}{4}$ to 2 g/m$^2$ for a 40 g/m$^2$ paper. The size composition may also include materials which do not themselves impart release properties but which can be used as "extenders" for the active release ingredient. Such materials include starches, polyvinyl alcohols and alginates.

The release composition may optionally include additives to contribute to hold out (i.e to prevent the subsequently applied adhesive coating from being excessively absorbed into the body of the paper) or to contribute to barrier properties.

The adhesive coating operation may be carried out by conventional methods, for example by means of a kiss and scrape coater, a web curtain coater, a reverse roll coater, a gravure coater or a blade coater. The paper used is preferably calendered to provide a smooth surface and good holdout with respect to the subsequently applied adhesive coating, and is preferably derived from a medium to wet-beaten pulp of a wetness of the order of 40° Schopper Riegler. A suitable paper substance is of the order of 40 g/m$^2$.

The adhesive may be a hot-melt adhesive formulation, particularly a formulation which also serves to impart barrier properties to the paper, e.g. with respect to water vapour, oil or grease. By this means, the permeability of the paper to water vapour may be reduced so as to give a moisture vapour transmission rate of not more than about 15 g/m$^2$/day, more preferably 10 g/m$^2$/day, when measured according to the method of British Standard 3177 under tropical conditions. Particularly suitable adhesive formulations are those utilising a blend of ethylene/vinyl acetate co-polymers and paraffin wax, optionally with a tackifying or modifying resin present as well. Such blends may be hot-melt coated on to the paper at a temperature of the order to 140° C. and after coating, they are activatable at temperatures of the order of 60° C. to 150° C. Ethylene/vinyl acetate co-polymers are sold by Du Pont under the trademark "Elvax", and detailed information on the use of Elvax/wax blends as hot-melt adhesives is given in Du Pont's promotional literature. Some examples of suitable hot-melt adhesive formulations are as follows (percentages are by weight):

(a) "Piccotex" 120 resin

-continued

| | | |
|---|---|---|
| | (sold by Pennsylvania Industrial Chemical Corporation of Clairton, Pennsylvania U.S.A.) | 25% |
| | Paraffin wax, melting point 154° F. | 40% |
| | "Elvax" copolymer 260 | 35% |
| (b) | Hercules resin "Dymerex" A 700 | 25% |
| | Paraffin wax, melting point 154° F. | 40% |
| | "Elvax" copolymer 260 | 35% |
| (c) | "Dymerex" A 700 | 30% |
| | Paraffin wax, melting point 154° F. | 40% |
| | "Elvax" terpolymer 4260 | 30% |

In compositions (a) and (b) above, "Elvax" terpolymer 4260 may be used instead of "Elvax" copolymer 260. In composition (c) "Elvax" copolymer 260 may be used instead of "Elvax" terpolymer 4260.

The adhesive coat weight to be used depends on the inherent adhesive properties of the adhesive composition used, but a typical coat weight is in the range of 15 to 20 g/m$^2$.

The adhesive may be coated over the whole surface of the web, or in a pattern, or, if desired, only on those areas where bonding is to occur.

In selecting a particular formulation for the adhesive, care must of course be taken to ensure that the adhesive is properly matched to the paper on which it is to be coated and from which it must release during a peeling apart operation. Consideration must be given not only to its cold adhesive properties (neither too weak to form a reliable bond nor too strong to prevent release) but also to its "hot tack", i.e. its bonding ability when still in the hot state just after activation, and hence its ability to withstand the filling operation.

A measure of hot tack may be obtained by superimposing two strips of material with their adhesive coated surfaces in contact, bonding an end portion of the strips together by means of heated jaws, removing the strips from the jaws and immediately attaching a weight to the free end of one strip and using the free end of the other strip to support the first strip. The still hot bond is then supporting the weight. Provided the bonding area, the temperature of the jaws, the pressure imposed by the jaws and the duration of the bonding operation are kept constant, the maximum weight which can be supported immediately provides an indication of the bond strength. At a temperature of 70° C., a pressure of 414 KPa (60 psi) a bonding time of 1 second, and with a bonding area of 483 mm$^2$ ($\frac{3}{4}'' \times 1''$) the maximum weight which can be supported is typically in the range 20 to 45 g, depending upon the packaging material, the adhesive and the release composition used.

Selection of adhesive formulations and size press compositions so as to achieve an acceptable balance of bonding and release properties is within the normal skill and expertise of specialist adhesives, coating and paper technologists. Since a novel product is being produced, a certain amount of trial and error will inevitably be involved, but this should not be substantially greater than is frequently encountered in papermaking and coating operations. Guidance is obtainable from the specific Examples given later.

It is desirable to aim for a balance of adhesive strength and release properties such that the bond can be peeled apart cleanly, i.e. without substantial pulling of fibres from the paper web by the adhesive. A slight amount of picking from the uncoated paper web can however be tolerated, particularly if especially high hot tack properties are desired in the manufacture of the package. "Picking" is an expression used to describe a situation in which a few isolated fibres adhere to the adhesive and are picked out of the body of other fibres of which they were originally part. This is somewhat analogous to fibres adhering to a printing roll or blanket after a printing impression has been made, which is also known as "picking". If the extent of picking becomes too great, bond breaking is starting to occur within the paper thickness rather than at the adhesive/release treated paper interface.

A measure of the force required to peel apart bonded thicknesses may be obtained by superimposing two strips of material with their adhesive coated surfaces in contact and bonding them along a substantial portion of their length. One strip is then peeled from the other at an angle of 90° (i.e. in a "T-on-its-side" configuration) and the peeling force is measured using a spring balance or a more sophisticated instrument such as an "Instron" tester. The force required to peel apart bonded thicknesses of material according to the invention is normally not greater than about 3 N (Neutrons) per 19 mm ($\frac{3}{4}''$) wide bonded thicknesses. It will be appreciated that the peeling force which can be tolerated will depend on the strength of the material being used. For the preferred grade of paper mentioned earlier, the peel-apart force is preferably in the range 0.3 to 1.5 N per 19 mm wide bonded thickness, more preferably 0.8 to 1.1 N per 19 mm wide bonded thickness.

In order to enable the invention to be more readily understood, reference will now be made to the accompanying drawings, which illustrate diagrammatically and by way of example an embodiment thereof, and in which.

Figure 1:
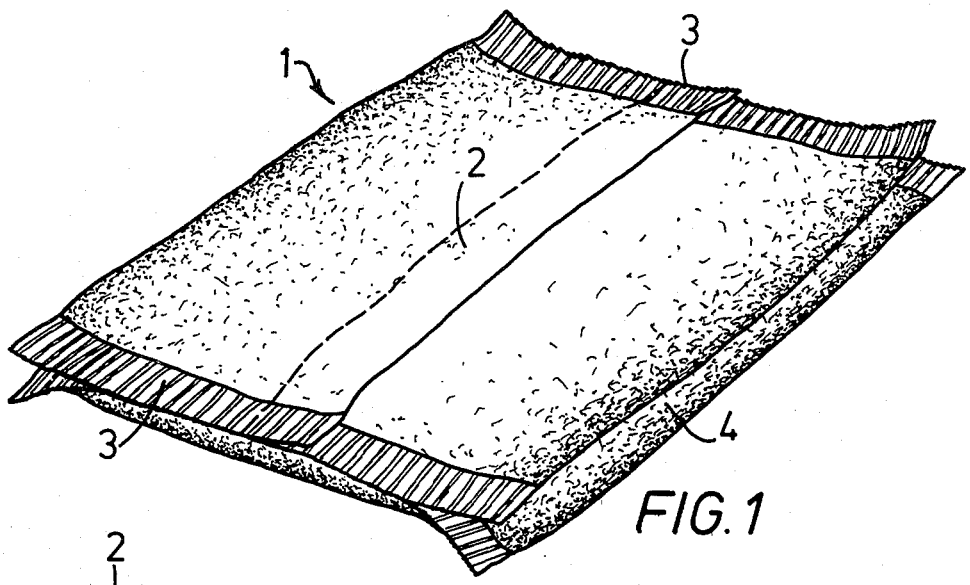
FIG. 1 is a perspective view of a gussetted filled package of the "pillow" type.

Referring to FIG. 1, a paper package shown generally as 1 comprises a single piece of paper which has been coated on its inner surface with a heat-activatable adhesive and treated with a release composition having release properties with respect to the adhesive. The longitudinal edge portions of the adhesive-coated surfaces of the paper are bonded together in a fin 2 and the transverse edges of the adhesive-coated surfaces of the paper are bonded together to form end closures 3. Each side of the package includes a gussetted portion generally shown as 4, the limit of the gussets being shown in broken outline.

Figure 2:
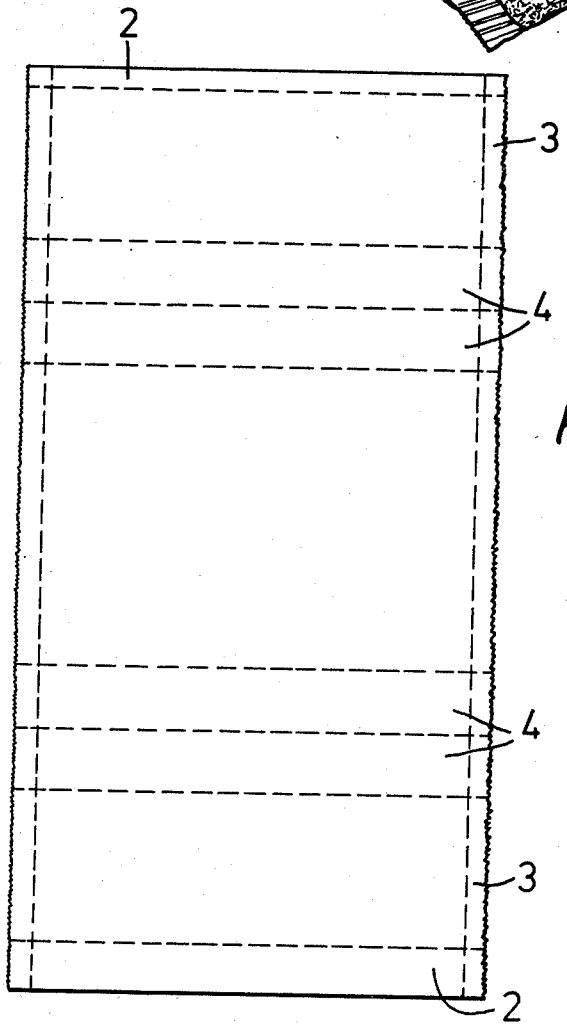
FIG. 2 is a plan view of a completely peeled apart package as shown in FIG. 1, showing bonded and folded over portions.

Referring now to FIG. 2, broken lines are used to indicate the longitudinal edge portions which bond together to form the fin 2 and the transverse edge portions which bond together to form the end closures 3. The folds defining the gussetted portions 4 are also shown by broken lines. The reference numerals used are as shown in FIG. 1.

Figure 3:
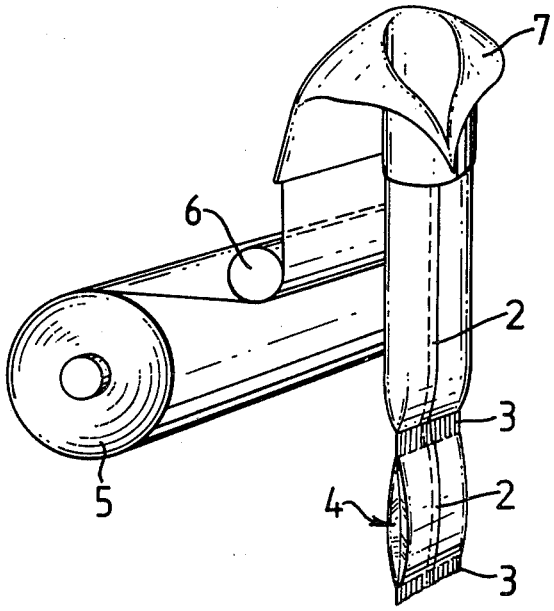
FIG. 3 is a perspective view of part of a vertical form-fill packaging machine in operation.

Referring now to FIG. 3, a form-fill packaging apparatus comprises an unwind station in which is a reel 5, a guide roll 6, and a forming collar 7. Respective pairs of heated jaws (not shown) are provided for longitudinally bonding the formed web into a tubular configuration, and for transversely bonding the tube to produce the end closures. Separate means (not shown) are also provided for dispensing fill material, and for severing each package after it has been formed by cutting the package end closures 3.

In operation, paper coated with a heat-activatable adhesive and sized with a composition having release properties with respect to the adhesive is unwound from the reel 5 and passed round the guide roll 6 and through the forming collar 7. This shapes the web into a tubular configuration, and the respective pairs of heated jaws effect longitudinal bonding to close the tube and transverse bonding to form a first package end closure. Fill material is dispensed into the tube from above. The tube is then moved downwards and the transverse pair of heated jaws form a transverse bond above the dispensed fill material in the tube. Each sealing operation of the jaws simultaneously provides the second end closure of the first package and also the first end closure of the next package. The transverse bonded portion is then severed to provide a discrete package.

The invention will now be illustrated by the following Examples (in which percentages are by weight):

EXAMPLES

A 40 g/m$^2$ supercalendered paper of the kind known as pouch stock was made on a Fourdrinier paper machine using a bleached kraft furnish, beaten to a wetness of 40° Schopper-Riegler. The paper was then treated with various release compositions. These compositions were applied at a temperature of 40° C. by means of a size press. The wet pick-up varied for different compositions, but was in the range 25 to 65%.

The thus treated papers were hot melt coated using one of two hot melt adhesive formulations as follows:

| Formulation A (% by weight) | |
|---|---|
| "Dymerex" A 700 resin | 30% |
| Paraffin wax, melting point 154 F. | 40% |
| "Elvax" terpolymer 4260 | 30% |

This formulatin was applied at a coatweight of 20 g/m$^2$.

| Formulation B (% by weight) | |
|---|---|
| "Piccotex" 38 0 120 resin | 25% |
| Paraffin wax, melting point 154° F. | 40% |

-continued

| Formulation B (% by weight) | |
|---|---|
| "Elvax" copolymer 260 | 35% |

This formulation was applied at a coatweight of 15 g/m$^2$.

The moisture vapour transmission rate (MVTR) was then measured according to the method of British Standard 3177 under tropical conditions, i.e. a temperature of 38° C. and at 90% relative humidity.

The paper was successfully used to produce pillow-type form-fill seal packages having peelable seals, i.e. the heat sealed end closures were strong enough to contain the contents, but could be peeled apart at the adhesive/release treated paper interface to enable the contents to be released. Paper tearing or splitting of the paper within its thickness did not occur. In some cases picking just occurred.

The force required (XKPa) to peel apart 19 mm wide bonded thicknesses after sealing using heated jaws at a temperature of 70° C. and a pressure of 414 KPa for 1 second was then measured according to the test method previously described. Two thicknesses of the paper were then bonded together at a pressure of 414 KPa and a temperature of 70° C. for 1 second, with a bonding area of 483 mm$^2$ and the maximum weight (Yg) which the immediate bond would support was then measured according to the test method previously described.

The full details of the compositions used and the results obtained are set out in the Table:

THE TABLE

| Example No. | Release Composition | Wet Pick-up (%) | Adhesive Formulation | MVTR (g/m$^2$/day) | Picking | Force X | Weight Y (g) |
|---|---|---|---|---|---|---|---|
| 1 | 0.5% Silicone ("Syloff" 1171) 1.5% starch | 31 | A | 8.7 | None | 1.02 | 30 |
| 2 | 2.8% "Quilon" 0.45% PVOH | 36 | A | 7.3 | Slight (acceptably so) | 1.08 | 35 |
| 3 | 4.2% "Quilon" 0.45% PVOH | 37 | A | 8.6 | Slight (as in Ex. 2) | 1.45 | 40 |
| 4 | 3.0% "Aquapel" 1.5% starch 0.45% sodium alginate | 31 | A | 8.3 | None | 1.03 | 35 |
| 5 | 0.8% "Scotchban" 4.5% starch | 65 | A | 20.4 | None | 0.86 | 40 |
| 6 | 4% "Aquapel" 5% starch | 30 | B | Less than 10 | None | Not measured | Not measured |

N.B. The percentages set out above are by weight, and in the case of "Sylcff", "Quilon" and "Aquapel", refer to the material as received at a certain solids content rather than to dry weights.

I claim:

1. A method of packaging a fill material comprising the steps of:

providing a continuous paper web impregnated with a release composition whereby said release composition is present on a surface of said web, the release treated surface being coated with an adhesive which is substantially non-tacky at ambient temperature and in the absence of pressure and forms a strong initial bond immediately on activation when two portions of said adhesive coated surface of said paper web are bonded together with adhesive coated surface in contact with adhesive coated surface, said release composition present on said surface of said paper web rendering said paper web releasable with respect to said adhesive whereby two portions of said adhesive coated surface of said paper web bonded together with adhesive coated surface in contact with adhesive coated surface may be peeled apart at an interface of said adhesive and said release treated surface of said paper web;

dispensing a quantity of fill material adjacent a first portion of said paper web; and, bonding a second portion of said paper web to said first portion to include the fill material and to form a closed package having closures peelable at an interface of said adhesive and said release treated surface of said paper web by bringing an adhesive coated surface area of said second paper web portion into contact with an adhesive coated surface area of said first paper web portion and bonding said adhesive coated surface areas together by activating said adhesive at said areas.

2. A method of packaging a fill material comprising the steps of:

providing a continuous paper web impregnated with a release composition whereby said release composition is present on a surface of said web, the release treated surface being coated with an adhesive which is substantially non-tacky at ambient temperature and in the absence of pressure and forms a strong initial bond immediately on activation when two portions of said adhesive coated surface of said paper web are bonded together with adhesive coated surface in contact with adhesive coated surface, said release composition present on said surface of said paper web rendering said paper web releasable with respect to said adhesive whereby two portions of said adhesive coated surface of said paper web bonded together with adhesive coated surface in contact with said adhesive coated surface may be peeled apart at an interface of said adhesive and said release treated surface of said paper web;

forming said paper web into a vertically disposed tubular configuration with a longitudinal edge portion of said adhesive coated surface in contact with the other longitudinal edge portion of said adhesive coated surface;

bonding said longitudinal edge portions together to form a longitudinal package closure by activating said adhesive at said longitudinal edge portions, aid longitudinal package closure being peelable at an interface of said adhesive and said release treated surface of said paper web;

bonding oppositely disposed transverse portions of said adhesive coated surface together to form a first package end closure by placing said transverse portions in contact and activating said adhesive at said transverse portions, said first package end closure being peelable at an interface of said adhesive and said release treated surface of said paper web;

dispensing a desired quantity of fill material into the partial package thus formed; and, bonding two further oppositely disposed transverse portions of said adhesive coated surface together above said fill material to form a second package end closure by placing said further transverse portions in contact and activating said adhesive at said further transverse portions, said second package end closure being peelable at an interface of said adhesive and said release treated surface of said paper web.

3. A package formed by the process of claim 1 or 2.

4. The method of claim 1 wherein said adhesive is heat activatable and said adhesive activating step comprises hot pressing said adhesive coated surface areas.

5. The method of claim 2 wherein said adhesive is heat activatable and said adhesive activating steps comprise hot pressing said respective adhesive coated surface portions.

6. The method of claim 1 wherein said adhesive is pressure activatable and said adhesive activating step comprises cold pressing said adhesive coated surface areas.

7. The method of claim 2 wherein said adhesive is pressure activatable and said adhesive activating steps comprise cold pressing said respective adhesive coated surface portions.

8. A package made in a vertical form, fill, seal process, said package comprising:

a single piece of a paper web impregnated with a release composition whereby said release composition is present on a surface of said web, the release treated surface being coated with an adhesive which is substantially non-tacky at ambient temperature and in the absence of pressure and forms a strong initial bond immediately on activation when two portions of said adhesive coated surface of said paper web are bonded together with adhesive coated surface in contact with adhesive coated surface, said release composition present on said surface of said paper web rendering said paper web releasable with respect to said adhesive whereby two portions of said adhesive coated surface of said paper web bonded together with adhesive coated surface in contact with adhesive coated surface may be peeled apart at an interface of said adhesive and said release treated surface of said paper web; and, said single paper web piece having first and second portions bonded together with an adhesive coated surface area of said first portion of said paper web piece bonded to an adhesive coated surface area of said second portion of said paper web piece, the bond being peelable at an interface of said adhesive and said release treated surface of said paper web.

9. A package according to claim 8 wherein longitudinal edge portions of said adhesive coated surface are bonded together to provide a longitudinal package closure and oppositely disposed transverse edge portions of said adhesive coated surface are bonded together to provide package end closures.

10. Flexible packaging material suitable for use in a vertical, form, fill, seal packaging process to produce packages of the pillow type, comprising:

a paper web impregnated with a release composition whereby said release composition is present on a surface of said paper web, the release treated surface being coated with an adhesive which is substantially non-tacky at ambient temperature and in the absence of pressure and forms a strong initial bond immediately on activation when two portions of said adhesive coated surface of said paper web are bonded together with adhesive coated surface in contact with adhesive coated surface, said release composition present on said surface of said paper web rendering said paper web releasable with respect to said adhesive whereby two portions of said adhesive coated surface of said paper web bonded together with adhesive coated surface in contact with adhesive coated surface may be peeled apart at an interface of said adhesive and said release treated surface of said paper web.

11. Flexible packaging material as claimed in claim 10 wherein said release composition is selected from the group consisting of a polysiloxane, an organochromium stearate complex, a ketene dimer resin, and a paper fluoridizing agent.

12. Flexible packaging material as claimed in claim 10 wherein said paper web is derived from a medium to wet-beaten pulp of a wetness of the order of 40° Schopper Reigler and is calendered to provide a smooth surface.

13. Flexible packaging material as claimed in claim 10, 11, or 12 wherein said release composition is present by sizepress treatment.

14. Flexible packaging material as claimed in claim 10 wherein said adhesive is formulated to impart barrier properties to said paper web.

15. Flexible packaging material as claimed in claim 10 and having a moisture vapor transmission rate of not more than about 20 $g/m^2/day$ when measured according to the method of British Standard 3177 under tropical conditions.

16. Flexible packaging material as claimed in claim 12, said adhesive and said release composition being such that on bonding a 483 $mm^2$ area of the adhesive coated surface of two thicknesses of the material together by pressing at a temperature of 70° C. and a pressure of 414 KPa for one second, the immediate bond will support a weight of at least 20 g.

17. Flexible packaging material as claimed in claim 12, said adhesive and said release composition being such that on bonding 19 mm wide strips of the adhesive coated surfaces of the material together by pressing at a temperature of 70° C. and a pressure of 414 KPa for one second, the force required to peel apart the bond when cold is not greater than 3 N.

18. The flexible packaging material of claim 10 wherein said adhesive is activatable by heat with the result that two thicknesses of said paper web are bondable together by hot pressing their adhesive coated surfaces together.

19. The flexible packaging material of claim 10 wherein said adhesive is activatable by pressure with the result that two thicknesses of said paper web are bondable together by pressing their adhesive coated surfaces together.

20. The flexible packaging material of claim 10 wherein said adhesive is activatable by heat and pressure.

21. In a vertical form, fill, seal method having the steps of forming a continuous packaging material into a vertically disposed tubular configuration with the longitudinal edge portions of the packaging material in contact, bonding said longitudinal edge portions together to form a longitudinal package closure, bonding oppositely disposed transverse portions of said packaging material together to form a first package end closure, dispensing a desired quantity of fill material into the partial package thus formed, and bonding two further oppositely disposed transverse portions of said packaging material together above said fill material to form a second package end closure, the improvement comprising:

using as said packaging material a continuous paper web impregnated with a release composition whereby said release composition is present on a surface of said web, the release treated surface being coated with an adhesive which is substantially non-tacky at ambient temperature and in the absence of pressure and forms a strong initial bond immediately on activation when two portions of said adhesive coated surface of said paper web are bonded together with adhesive coated surface in contact with adhesive coated surface, said release composition present on said surface of said paper web rendering said paper web releasable with respect to said adhesive whereby two portions of said adhesive coated surface of said paper web bonded together with adhesive coated surface in contact with adhesive coated surface may be peeled apart at an interface of said adhesive and said release treated surface of said paper web; and forming each said package closure by bringing a first portion of said adhesive coated surface of said paper web into contact with a second portion of said adhesive coated surface and bonding said adhesive coated surface portions together by activating said adhesive at said portions, each said package closure thereby formed being peelable at an interface of said adhesive and said release treated surface of said paper web.

* * * * *